United States Patent [19]

Maeyama

[11] 4,065,690

[45] Dec. 27, 1977

[54] X-RAY TUBE WITH A CONTROL GRID

[75] Inventor: Shigeo Maeyama, Fujisawa, Japan

[73] Assignee: Tokyo Shibaura Electric Co., Ltd., Kawasaki, Japan

[21] Appl. No.: 762,815

[22] Filed: Jan. 26, 1977

[30] Foreign Application Priority Data

Jan. 29, 1976 Japan ..... 51-8153[U]

[51] Int. Cl.[2] ..... H01J 35/00

[52] U.S. Cl. ..... 313/57; 313/55

[58] Field of Search ..... 313/57

[56] References Cited

U.S. PATENT DOCUMENTS 2,108,573 2/1938 After ..... 313/57

*Primary Examiner*—James B. Mullins
*Assistant Examiner*—Darwin R. Hostetter
*Attorney, Agent, or Firm*—Cushman, Darby & Cushman

[57] ABSTRACT

An X-ray tube has a control grid located to cover a filament which is insulatingly mounted on a first focusing electrode. The control grid is electrically connected to the first focusing electrode. A second focusing electrode is so mounted on the first focusing electrode through an insulator that it covers the control grid. The second focusing electrode is made at the same potential level with that of the filament.

2 Claims, 3 Drawing Figures

X-RAY TUBE WITH A CONTROL GRID

BACKGROUND OF THE INVENTION

This invention relates to an X-ray tube and more particularly an X-ray tube equipped with a control grid located between a cathode and an anode to control electrons emitted from the cathode.

Generally, a cathode of a control grid-equipped X-ray tube has a cathode body on which is mounted a focusing electrode means having first and second focusing electrodes and a filament. The control grid is disposed between the first and second focusing electrodes. The grid and second focusing electrode are electrically connected to the first focusing electrode, and the second focusing electrode has an opening toward which the filament extends and through which electrons emitted from the filament passes. The first and second focusing electrodes and control grid are made at the same potential level and upon application of a grid bias an electric current in the tube is controlled, thereby causing electrons passing through an opening of the second focusing electrode to impinge upon an anode target under a controlled fashion. As a result, a desired X-ray is obtained from a focus on the anode target. During the use of the tube, however, an ionization current of a residual gas in the tube flows into a grid circuit, tending to change the grid bias. When the bias voltage is changed, no same potential is obtained from the filament and first and second focusing electrodes and in consequence the focusing state of electrons passing through the opening of the second focusing electrode is varied. In this case, a focus pattern on the anode target is varied, making it impossible to positively obtain a desired X-ray. Furthermore, a bias voltage becomes positive due to the ionization current of the residual gas in the tube. In this case, it is impossible to provide a stable grid control and in the worst case the X-ray tube suffers damage.

To eliminate such drawbacks a control grid equipped X-ray tube is known in which the grid is insulated from the first focusing electrode, first and second electrodes are made at the same potential level with that of a filament, and a bias voltage is applied to the grid. Since the first focusing electrode is small, for example, 25 to 30 mm in diameter and 10 to 15 mm in thickness, however, a greater insulator can not be disposed between the grid and the first focusing electrode. When a high grid bias of −2000 to −3000V is applied it is impossible to entirely insulate the grid from the first focusing electrode and in consequence it is impossible to provide a stable grid bias.

SUMMARY OF THE INVENTION

It is accordingly an object of this invention to provide a control grid equipped X-ray tube capable of providing a highly reliable, stable grid control by stably applying a bias voltage to the grid.

According to a preferred embodiment of this invention a control grid is electrically connected to a first focusing electrode and a second focusing electrode is mounted on the first focusing electrode through an insulator. A filament is made at the same potential level with that of the second focusing electrode. Since the insulator is disposed, unlike a conventional X-ray tube, between the first and second focusing electrodes a greater insulator can be adapted. This permits complete insulation between the first and second focusing electrodes. As a result, a reliable grid control can be obtained, for the filament is made at the same potential level as that of the second focusing electrode.

DETAILED DESCRIPTION OF THE PREFERRED EMBODIMENT

Figure 1:
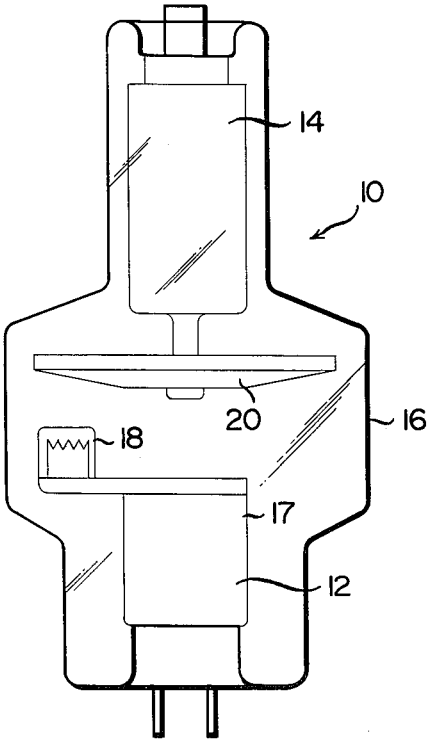
FIG. 1 is a front view diagrammatically showing a control grid equipped X-ray tube according to one embodiment of this invention.
Figure 2:
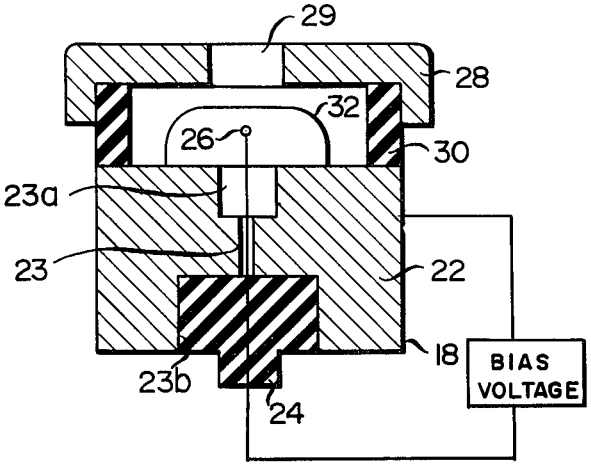
FIG. 2 is an enlarged, cross-sectional view showing a focusing electrode means in FIG. 1 in more detail.

As will be seen from FIG. 1 an X-ray tube 10 with a control grid has a cathode 12 at one end of an air-sealed envelope 16 and an anode 14 at the other end of the envelope. The cathode 12 and anode 14 are hermetically sealed in the envelope 16. The cathode 12 has a cathode body 17 on which a focusing electrode means 18 is eccentrically mounted on that surface of the cathode 12 which confronts the anode 14. The anode 14 has a target 20 which confronts the focusing electrode means 18. A filament is received in the focusing electrode means 18 and a control grid is disposed to cover the filament. As shown in more detail in FIG. 2 the focusing electrode means 18 is equipped with a first focusing electrode 22 having a stepped through bore 23. The stepped through bore 23 is enlarged at each end to provide upper and lower recesses **23*a* and 23*b*. An insulator 24 is embedded in the lower recess 23*b* of the stepped through bore 23, and a filament 26 secured to the insulator 24 extends through and beyond the upper recess 23*a*. A second focusing electrode 28 is mounted on the first focusing electrode 22 through an insulator 30 and has an opening 29 toward which the filament 26 extends. A control grid 32 is disposed between the first and second focusing electrodes 22 and 28 to cover the filament 26. Each end of the grid 32 is electrically connected to the first focusing electrode 22**.

The first focusing electrode 22 and control grid 32 are at the same potential level and the second focusing electrode 28 and filament 26 are at the same potential level. A grid bias is applied between the grid 32 and the filament 26. Since the second focusing electrode 28 for controlling the pattern of a focus to be formed on the anode target 20 is at the same potential level with the filament 26, it suffers no influence from the variation of a grid bias resulting from the ionization current of a residual gas in the tube. In consequence, the second focusing electrode 28 permits a desired focusing pattern to be positively formed on the anode target. Even if the grid bias is varied by a very small ionization current of a residual gas in the tube, a stable grid control is obtained, since the second focusing electrode 28 is at the same potential level with the filament 26. With the X-ray tube according to this invention the insulator 30 is disposed, unlike a conventional X-ray tube, between the first and second focusing electrodes 22 and 28 and in consequence of greater insulator can be used as the insulator 30 so that the second focusing electrode is completely insulated from the first focusing electrode.

Figure 3:
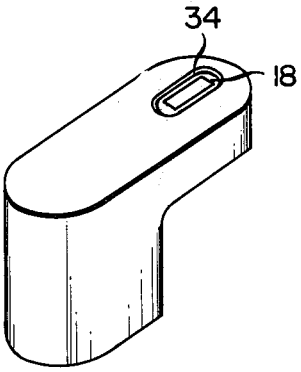
FIG. 3 is a perspective view showing a modified form of a cathode body in FIG. 1.

As shown in FIG. 1 the focusing electrode means 18 is usually provided in a manner to project from the cathode body 17. The ionization current in the tube is generated mainly between the focusing electrode means 18 and the anode target 20 and it also generated between the cathode body 17 and the anode target 20. Where the focusing electrode means 18 is projected from the cathode body 17 a nonuniform electric field is created and in consequence the ionization current is liable to occur. In FIG. 3 a blind recess 34 is formed in an extending arm of the cathode body 17 and the focusing electrode means, together with the grid, is embedded in the blind recess 34 of the cathode body 17 so that the top surface of the second focusing electrode is substantially flush with the top surface of the cathode body. By so doing, it is possible to prevent generation of ionization current in the tube and in consequence it is possible to prevent a flow of the ionization current into the control grid.

The above-mentioned embodiment is only by way of explanation and should not be taken as restrictive. This invention can be varied in a variety of ways without departing from the spirit and scope of this invention.

What is claimed is:

1. A grid-equipped X-ray tube including a cathode having a cathode body one end of which is hermetically sealed to one end of an air-sealed envelope and on the other end of which a focusing electrode means is mounted, an anode one end of which is hermetically sealed to the other end of the envelope and on the other end of which a target facing the focusing electrode means is mounted, and a control grid disposed between the cathode and the anode, the improvement in which said focusing electrode means comprises a first focusing electrode having a stepped through bore, a filament insulatingly mounted on the first focusing electrode and part of which extends out through the bore, a second focusing electrode mounted on the first focusing electrode through an insulator and having an opening toward which the filament extends, the second focusing electrode having a potential level the same with that of the filament electrode, and said control grid disposed between the first focusing electrode and the second focusing electrode to cover the filament and each end of which is electrically connected to the first focusing electrode.

2. A grid-equipped X-ray tube according to claim 1 in which said focusing electrode means is embedded in a recess formed in an extending end of the cathode body so that the top surface of the second focusing electrode of said focusing electrode means is substantially flush with the top surface of the cathode body.

* * * * *